US006085736A

United States Patent [19]

Osterhues

[11] Patent Number: 6,085,736

[45] Date of Patent: Jul. 11, 2000

[54] ARCHERY BOW STABILIZER

[76] Inventor: Mark P. Osterhues, 810 E. Lakeshore Dr., Tower Lakes, Ill. 60010

[21] Appl. No.: 09/376,605

[22] Filed: Aug. 18, 1999

[51] Int. Cl.[7] ..... F41B 5/20

[52] U.S. Cl. ..... 124/89

[58] Field of Search ..... 124/86, 88, 89

[56] References Cited

U.S. PATENT DOCUMENTS

| | | | |
|---|---|---|---|
| 3,196,860 | 7/1965 | Hoyt | 124/89 |
| 3,412,725 | 11/1968 | Hoyt, Jr. . | |
| 3,524,441 | 8/1970 | Jeffery . | |
| 3,589,350 | 6/1971 | Hoyt, Jr. . | |
| 3,628,520 | 12/1971 | Izuta . | |
| 3,670,710 | 6/1972 | Izuta . | |
| 4,245,612 | 1/1981 | Finlay | 124/89 |
| 4,553,522 | 11/1985 | Topping | 124/89 |
| 4,556,042 | 12/1985 | Izuta | 124/89 |
| 4,615,327 | 10/1986 | Saunders | 124/89 |
| 4,955,356 | 9/1990 | Pike et al. | 124/89 |
| 5,613,484 | 3/1997 | Troncoso | 124/89 |
| 5,669,370 | 9/1997 | Breedlove | 124/89 |
| 5,735,257 | 4/1998 | Walk | 124/89 |
| 5,904,134 | 5/1999 | Denbow | 124/89 |

OTHER PUBLICATIONS

Vibracheck & Enterprises (R & R Enterprises, Inc.) Brochure (undated, circulated in 1998, 1999).

*Primary Examiner*—John A. Ricci
*Attorney, Agent, or Firm*—James P. Hanrath

[57] ABSTRACT

An archery bow stabilizer includes a first weight body and a second weight body. One of the weight bodies has structure (such as a threaded stem attached to a central longitudinal axis thereof or a threaded bore along a central longitudinal axis thereof cooperative with a threaded set screw) for engaging it to an archery bow. The other weight body has structure (such a threaded bore at central longitudinal axis thereof cooperative with the threaded stem of the other weight body or a set screw having a first end portion and a second end portion, the first end portion engaging the threaded bore of one of the weight bodies and the second end portion engaging the threaded bore of the other weight body) to releasably connect the weight bodies to each other in a single longitudinal axially aligned plane intersecting the bow and disposing the bow between the weight bodies to thereby form a stabilizer assembly having sufficient mass to provide inertia resistance for stabilizing the bow against movement.

15 Claims, 4 Drawing Sheets

ARCHERY BOW STABILIZER

BACKGROUND OF THE INVENTION

1. Field of the Invention

The present invention relates generally to archery bows, and more particularly to an inertial stabilizer adapted to be readily attached to practically all types of archery bows for torque reduction, lateral stabilization, and absorbing and damping out shocks and vibrations, caused in the archery bow.

2. Description of the Related Art

One of the heretofore unavoidable occurrences following the archer's release of an arrow has been the tendency of the bow to be laterally and rotationally displaced, that is, the handle section of the bow moves in a vibrating manner in a direction away from the arrow as it passes around the bow handle. Inasmuch as the ultimate cast of the arrow is affected throughout the time the bow string is moving from its retracted position to its forward most position due to the constant pressure exerted on the arrow notch by the bow string, it follows that any concurrent rotational displacement of the handle section or arrow rest of the bow during this period must ultimately affect the resulting cast of the arrow; accordingly it will be readily appreciated that any effort made to inhibit or dampen this displacement of the bow by increasing the stability thereof will be a great advantage to the archer.

Many attempts have heretofore been made to provide bows with means for cushioning the shock to the holding hand of the archer upon the release of the bow string which is a substantial shock occasioned by the poundage or leverage of the bow. When an arrow is notched on an archery bow and the latter is fully drawn, a vibration of small amplitude but of a higher pitch is created due to the highly tensioned archers's muscles, and when the arrow is released, vibration or shock of far more intensified amplitude is created due to the abrupt recovery of the limbs and the string of the archery bow to their original positions. A stabilizer for an archery bow is employed for absorbing these vibrations or shocks, and also for compensating any unbalance in moments of inertia which might exist around the hand-gripping portion of the archery bow, especially in the right and left direction of the bow.

In order to absorb these vibrations and shocks for stabilizing the operation of the archery bow and for improving hitting rate thereof, one or more stabilizers are rigidly attached by various means to the outward face of the bow, and typically to the handle riser of the archery bow. Most of the conventional stabilizers have been constructed in a simple matter comprising a weight body and a comparatively long rod member integrally joined to each other wherein one end thereof is attached to the bow and the stabilizer extends forwardly of the bow so it can be vibrated easily. Examples of such stabilizers mounted to the outer face of a bow, which include differing types of weight bodies forming the stabilizer, are disclosed in U.S. Pat. Nos. 3,412,725, 3,524,441, 3,589,350, 3,628,520, 3,670,712, 4,245,612, 4,615,327, 4,955,356, 5,669,370 and 5,735,257.

However, it is known that a limited degree of bow rotation is necessary to ensure proper passage of the arrow from the bow, and without the use of any stabilizing means at all this bow rotation occurs in too great a degree and begins to early following the arrow release thereby precluding a smooth follow-through during the release of the bow string. In other words, it has been established that inertia stabilizing means is definitely an advantage, however to be entirely satisfactory, it must provide the proper damping action while not restricting the necessary bow rotation. Further, to create a faster dampening action by counteracting the shock and vibration of the bow limbs after the arrow is released, several variables must be taken into account, namely the bow weight, arrow mass weight, arrow spine, and the archer's bow grip and arrow release. For example, bow weight can be a significant factor, especially with archer accessories such as quivers, arrow holders, or sight-line hardware being accommodated upon the bow which affects the lateral moment of inertia of the bow. Still further, the orientation of the stabilizer on the bow or bow riser is a significant factor in its function. All the foregoing must be considered in the provision of stabilizer means for an archery bow. Quite obviously, neither bow manufacturers or the archers would consider maintaining a stock of an infinite number of heavy weighting components in order to provide a personalized required inertial stabilization when confronted with anyone of the numerous shooting circumstances, bow types, bow accessories, and archer characteristics.

In view of the foregoing, it is advantageous to provide an inertial stabilizer for an archery bow which can provide an adjustable and variable dampening effect by permitting the usage and interchange of selected stabilizer weight bodies at selected personalized locations of a bow or bow riser suited to accommodate various shooting circumstances, archery equipment, and archer characteristics.

SUMMARY OF THE INVENTION

In accordance with the present invention there is provided an archery bow stabilizer comprising a first weight body and a second weight body, means for engaging at least one of the weight bodies to an archery bow, and means for releasably connecting the first and second weight bodies to each other in a single longitudinal axially aligned plane relative to each other intersecting the bow and disposing the bow between the first and second weight bodies, the first and second weight bodies when so connected forming a stabilizer assembly having sufficient mass to provide inertial resistance for stabilizing the bow against movement. The first and second weight bodies may be of differing masses, thereby providing for variation of the formed composite stabilizer assembly. The means for engaging at least one of the weight bodies to an archery bow preferably includes one weight body having a threaded stem or set screw attached thereto and extending therefrom for insertion into a pre-existing or retrofit made hole of the archery bow. The means for releasably connecting the first and second weight bodies to each other in a single longitudinal axially aligned plane relative to each other and intersecting the bow and disposing the bow between the first and second weight body preferably comprises each of the weight bodies having a threaded bore at a central longitudinal axis thereof suitable to receive a threaded set screw having a first end portion and second end portion, the first end portion being of suitable length to engage the threaded bore of one of the weight bodies and the second end portion being of suitable length to engage the threaded bore of the other weight body, the set screw thereby allowing each of the weight bodies to be screwed thereon toward each other in a single longitudinal axially aligned plane to thereby form a stabilizer assembly which releasably captures and disposes an archery bow or bow riser between the connected first and second weight bodies. Alternatively, one of the weight bodies may have an integral threaded stem attached at the longitudinal central axis thereof and extending therefrom for entry into a cooperative threaded bore of the other weight body. Unscrewing one weight body from the threaded set screw or threaded stem permits release and removal of the stabilizer assembly from the hole of the bow or bow riser.

Washers may be optionally employed on the threaded set screw or threaded stem to serve as a brace buffer against the archery bow or bow riser captured and disposed between the first and second weight bodies. Likewise, weight elements of varying weight and shape, such as blocks, cylinders, spacers, rings, washers, nuts or other weighted pieces having a through hole or threaded through bore may be optionally set upon the threaded set screw or threaded stem to be captured and disposed between the first and second weight bodies as an inside mounted piece, thereby permitting a selectable and variable fine tuning of the ultimate weight and mass of the archery bow stabilizer of the present invention.

In another embodiment of the invention, either or both of the first and second weight bodies may be modified to be comprised of a plurality of cooperative weight units forming the weight body as opposed to the same being a singular integral weight body.

The archery bow stabilizer of the present invention can cooperate with a single pre-existing hole or threaded bore of an archery bow or bow riser or the archery bow or bow riser may be retrofitted with a hole or threaded bore suited for engagement with the subject bow stabilizer. However, it is preferred that the archery bow or bow riser have a plurality of holes or threaded bores at strategic locations thereof to permit variations of location and orientation of the subject stabilizer when the stabilizer engages a selected hole or threaded bore.

The archery bow stabilizer of the present invention is particularly useful in achieving a lateral stabilization of a bow which accommodates archery accessories such as quivers or arrow holders, a supply of arrows, or sight-line hardware at one side of the bow. In this regard, a threaded hole suited to engage the subject bow stabilizer may extend in a lateral intersection through the bow allowing the bow stabilizer to be disposed as a laterally extending counterweight balancing the laterally adjacent archery accessories mounted to the bow and stabilizing the lateral moment of inertia of the bow.

A user of the archery bow stabilizer of the present invention may select, employ, interchange, and combine weight bodies of differing mass to form a variety of stabilizer assemblies suited to provide an inertial stabilization of an archery bow or bow riser. The user may also alter the location and orientation of the stabilizer assemblies relative the archery bow or bow riser by selectively employing the same in one or more of multiple pre-existing or retrofit made threaded holes of the archery bow or bow riser. Still further, weight elements having a through hole or threaded through bore may be optionally mounted upon the threaded set screw or threaded stem of the archery bow stabilizer of the present invention to be captured and disposed between the first and second weight bodies to thereby provide for a selectable and variable fine tuning of the ultimate weight and mass of the archery bow stabilizer. Such features of the present invention advantageously allow users of the same to achieve a personalized bow stabilizing/dampening effect best suited to and accommodating differing shooting circumstances, archery equipment, and archer characteristics. Further, the archery bow stabilizer of the present invention is suited to be readily adapted to a wide variety of archery bows and bow risers; alternatively, other archery bows and bow risers may be easily retrofitted with a drill hole or threaded bore to accommodate the archery bow stabilizer of the present invention.

Additional features and advantages of the present invention will become apparent to those skilled in the art from the following description and the accompanying figures illustrating preferred embodiments of the invention, the same being the present best mode for carrying out the invention.

DESCRIPTION OF THE PREFERRED EMBODIMENTS

Figure 1:
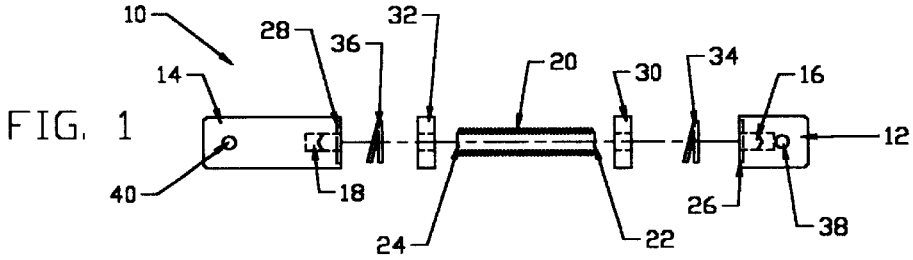
FIG. 1 is a side elevation schematic view of one embodiment of an archery bow stabilizer of the present invention with the components thereof longitudinally exploded from each other.

Referring now to the drawings, there is shown in FIG. 1 a side elevation schematic view of archery bow stabilizer 10 of the present invention with the components thereof longitudinally exploded from each other. Bow stabilizer 10 includes a first weight body 12 and a second weight body 14 each of which having a threaded bore, 16 and 18 respectively, centered at their longitudinal axis. The threaded bores 16 and 18 are suited to threadly receive a set screw 20 having a first end portion 22 and a second end portion 24, the first end portion 22 capable of engaging threaded bore 16 of the first weight body 12 and the second end portion 24 capable of engaging threaded bore 18 of the second weight body 14. Set screw 20, when coupled with one of its end portions set within one of the weight bodies, serves as a means for engaging at least one of the first or second weight bodies to a preexisting or retrofit made hole or bore of an archery bow riser or an archery bow by insertion of the remainder of set screw therein. Set screw 20 when so engaged in a preexisting or retrofit made hole or bore of an archery bow riser or archery bow has an exposed end portion available to be coupled to the other weight body thus providing means for releasably connecting the first and second weight bodies to each other in a single longitudinal axially aligned plane relative to each other capable of intersecting an archery bow or bow riser and disposing the bow or bow riser between a recessed inward face 26 of the first weight body 12 and a recessed inward face 28 of the second weight body 14. Set screw 20 may be of varying length to accommodate different bows or additional weight elements or washers mounted thereon. Optionally, washers 30 and 32 and lock rings 34 and 36 may be mounted on set screw 20 to serve as a brace cushion to a bow or bow riser disposed between the first and second weight bodies. Lock rings 34 and 36 are accommodated in the recessed inward faces 26 and 28 of the first weight body 12 and the second weight body 14 respectively. The first weight body 12 and the second weight body 14 are also each provided with wrench stem holes 38 and 40 respectively such that a wrenching stem may be inserted therein to assist in screwing or unscrewing the weight bodies upon set screw 20. When the first and second weight bodies are connected upon set screw 20 in a single longitudinal axially aligned plane, bow stabilizer 10 has sufficient mass to provide inertial resistance for stabilizing the bow or bow riser against movement.

Figure 2:
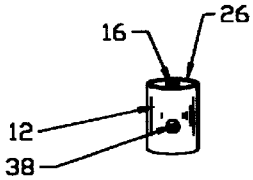
FIG. 2 is a perspective view of the first weight body of the archery bow stabilizer shown in FIG. 1.
Figure 3:
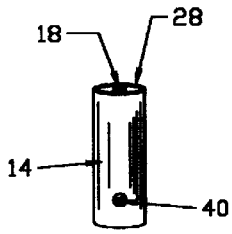
FIG. 3 is a perspective view of the second weight body of the archery bow stabilizer shown in FIG. 1.
Figure 4:
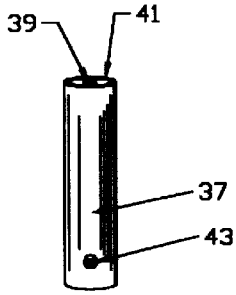
FIG. 4 perspective view of a lengthened weight body of the archery bow stabilizer of the present invention.

FIG. 2 and FIG. 3 are perspective views of the first weight body 12 and second weight body 14, respectively, and illustrate that the first and second weight bodies may be of differing length and weight. Indeed, FIG. 4 is a perspective view of a lengthened weight body 37 having a threaded bore 39, a recessed inward face 41, and a wrench stem hole 43. FIGS. 2 through 4 illustrate that the weight bodies of the present invention may be of differing length, and thus of differing, preferably incremental, overall weight, so that the weight bodies are variable from one another to provide for an interchangeability of selected weight bodies from a group or pool of several variable weight bodies of incremental weight to achieve a composite archery bow stabilizer personalized to the archery equipment, archery shooting circumstances, and the feel or needs of the archer. Although weight bodies 12, 14, and 37 are illustrated as being substantially tubular or cylindrical in shape, the weight bodies of the present invention may be of a variety of shapes and differing mass provided they have a threaded bore at an inward facing surface.

Figure 5:
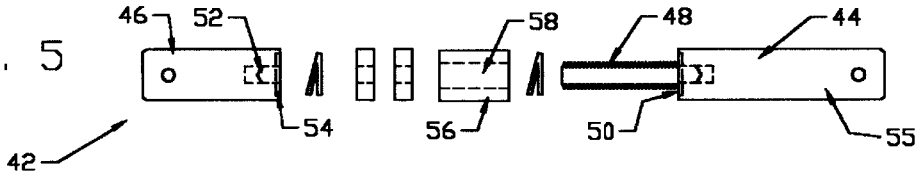
FIG. 5 is a side elevation schematic view of a second embodiment of an archery bow stabilizer of the present invention with the components thereof longitudinally exploded from each other.

FIG. 5 is a side elevation schematic view of another embodiment of the present invention and illustrates archery bow stabilizer 42 with the components thereof longitudinally exploded from each other. Bow stabilizer 42 includes a first weight body 44 and a second weight body 46. First weight body 44 has an integral threaded stem 48 extending from the central longitudinal axis of its recessed inward face 50 suited to be cooperatively received within a central threaded bore 52 at the recessed inward face 54 of the second weight body 46 in a manner previously described. Threaded stem 48, similar to set screw 20, may be of varying length to accommodate differing bows or additional weight elements or washers mounted thereon and captured between the first and second weight bodies.

Moreover, as illustrated at FIG. 5, the weight bodies of the present invention need not be a singular integral piece but may be comprised of a plurality of pieces. For example, the first weight body 44 may also serve as a first cooperative weight unit 55 which cooperates with a second cooperative weight unit 56 to form a two piece composite weight body. In this regard, the second cooperative weight unit 56 is provided with a clearance hole 58 (or threaded bore) throughout its central longitudinal axis such that the second cooperative weight unit 56 is suited to be slidably mounted upon the integral threaded stem 48 extending from the central longitudinal axis of recessed inward face 50 of first cooperative weight unit 55. When integral threaded stem 48 is threadly engaged into central threaded bore 52 of the second weight body 46 to capture a bow riser or archery bow between the first and second weight bodies, the second cooperative weight element 56 is releasably lock braced adjacent the first cooperative weight unit 55 to form a composite two piece weight body.

Figure 6:
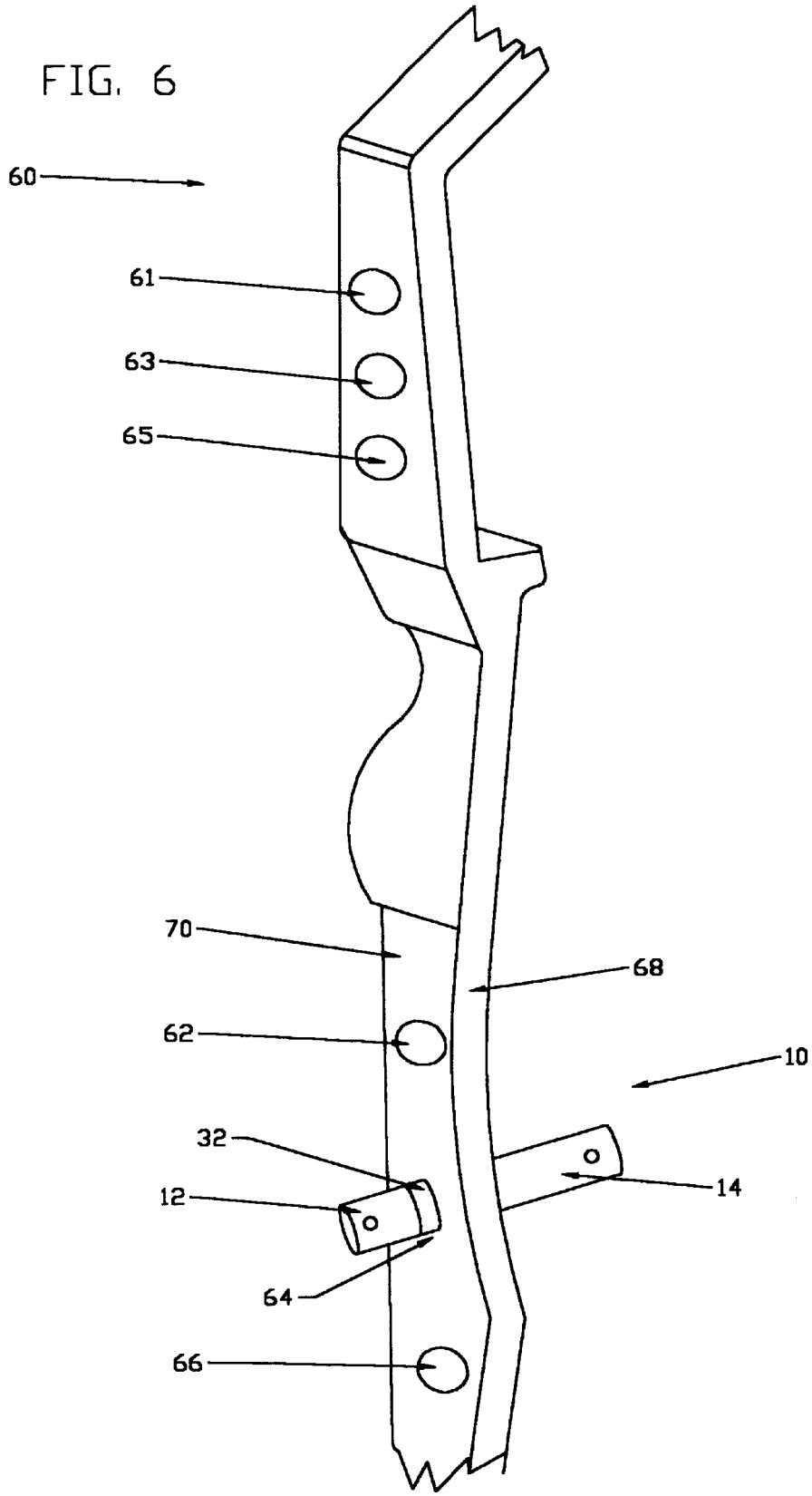
FIG. 6 is a frontal side perspective view of the archery bow stabilizer shown in FIG. 1 attached to a selected location of an archery bow riser at an orientation disposing the archery bow stabilizer at an angle perpendicular to a side surface of the bow riser and extending to the left and right of the bow riser.

In FIG. 6 there is shown a frontal side perspective view of an archery bow riser 60, shown in fragmentary view, which has a plurality of traverse holes (or threaded bores) 62, 64, and 66 extending between the left side surface 68 and the right side surface 70 of the bow riser 60 at selected among potential variable locations thereof (see also the arbitrary select locations of traverse holes 61, 63, and 65). Bow stabilizer 10 is illustrated fully mounted at selected traverse hole 64 of bow riser 60 in a manner which disposes bow stabilizer 10 at an angle perpendicular to left side surface 68 and the right side surface 70. The first weight body 12 and the second weight body 14 of bow stabilizer 10 are connected to each other via set screw 20 in a single axially aligned plane relative each other which intersects bow riser 60 and disposing bow riser 60 between them such that the weight bodies extend to the left and right sides of bow riser 60. An archery bow or bow riser may also be retrofitted with traverse holes or holes of other orientation to accommodate the archery bow stabilizer of the present invention.

Figure 7:
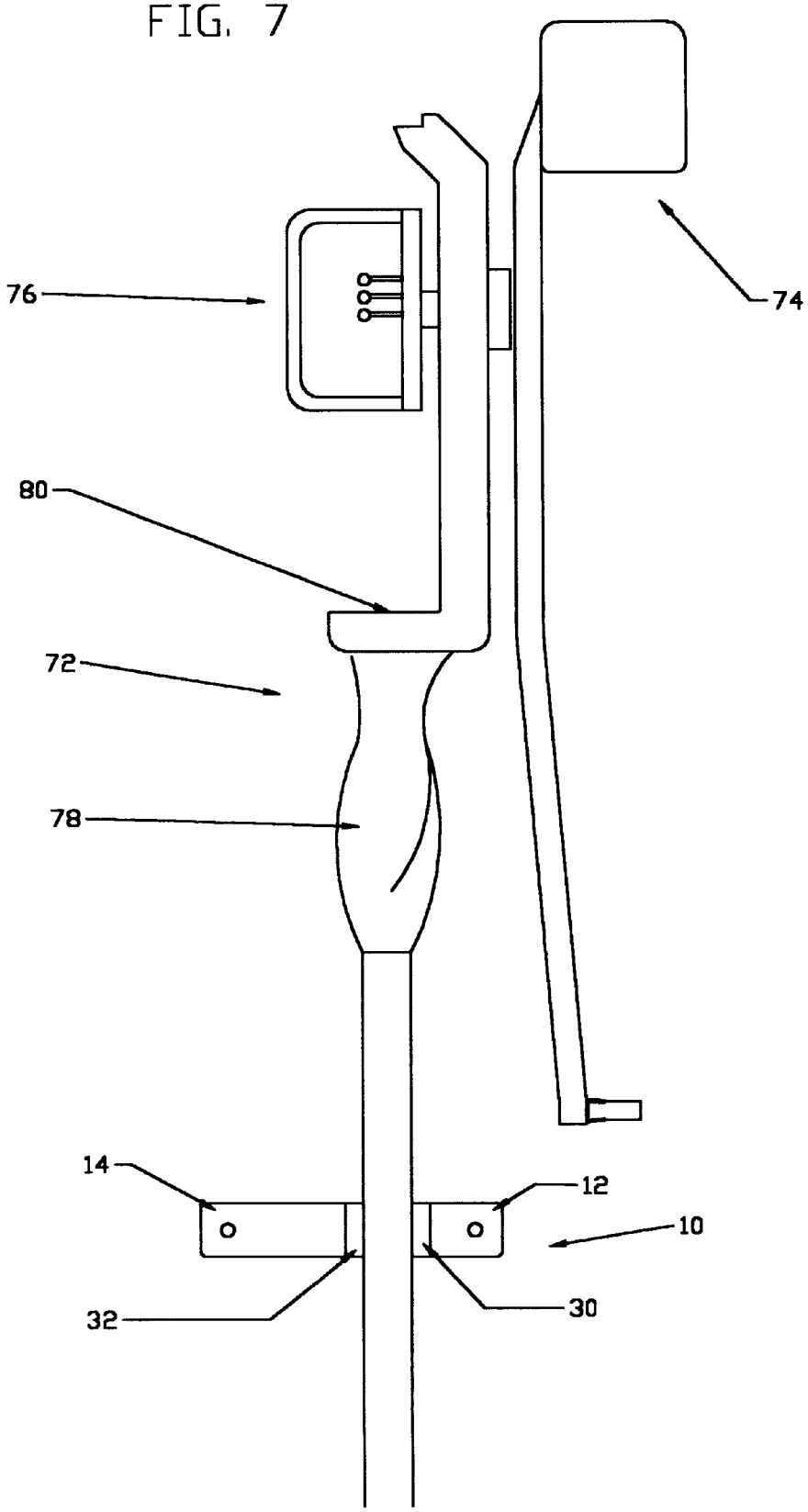
FIG. 7 is a rear perspective view of the archery bow stabilizer shown in FIG. 1 attached to a selected location of an archery bow riser at an orientation disposing the archery bow stabilizer at an angle perpendicular to a side surface of the bow and extending to the left and right of the bow to serve as a counterweight to archery accessories attached to the bow.

In the rear perspective view of FIG. 7, the archery bow stabilizer 10 is shown fully attached to a selected location among a plurality of traverse holes (see traverse holes 71, 73, 75 of corresponding FIG. 8) of archery bow 72, shown in fragmentary view, and again has an orientation disposing the archery bow stabilizer 10 at an angle perpendicular to the side surfaces of the bow and extending to the left and right of the bow in order to counterbalance and laterally stabilize archery accessories attached to the bow, namely quiver assembly 74 and sight-line hardware 76. The counter balance is achieved by second weight body 14 disposed at the left side of the bow acting as a lateral counterweight to the first weight body 12, quiver assembly 74, and sight-line hardware 76 attached or disposed at the right side of the bow. Archery bow 72 includes hand grip 78 and arrow shelf 80.

Figure 8:
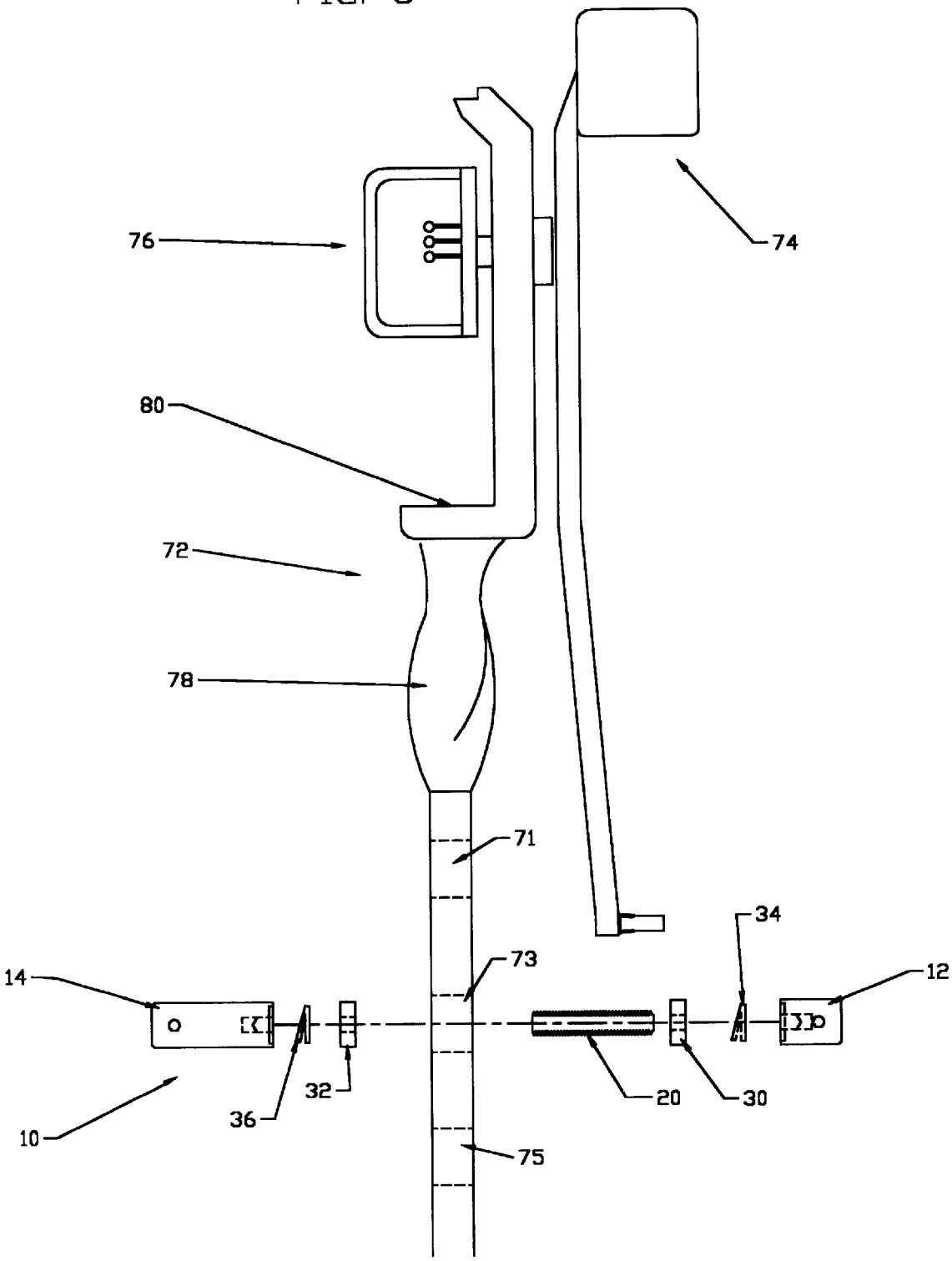
FIG. 8 is a rear perspective view, with hidden lines, of the archery bow riser and archery bow stabilizer shown in FIG. 7 with the components of the archery bow stabilizer longitudinally exploded from each other.

FIG. 8 illustrates a rear perspective view, with hidden lines, of archery bow 72 as in FIG. 7 but now shows archery bow stabilizer 10 longitudinally exploded to illustrate the component parts thereof and how they would be assembled to be attached to archery bow 72 in a matter which laterally intersects bow 72 and disposes bow 72 to be captured between first weight body 12 and second weight body 14. To prevent abrasion to bow 72, lock rings 34 and 36 and washers 30 and 32 are mounted on set screw 20 to serve as a brace cushion between bow 74 and the first and second weight bodies.

Figure 9:
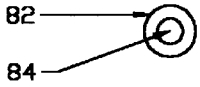
FIG. 9 is a side perspective view of an o-ring weight element suitable for mounting upon the set screw or threaded stem of the archery bow stabilizer of the present invention to be captured between the first and second weight bodies thereof.
Figure 10:
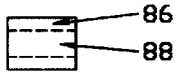
FIG. 10 is a side elevation schematic view of an aligned weight element suitable for mounting upon the set screw or threaded stem of the archery bow stabilizer of the present invention to be captured between the first and second weight bodies thereof.
Figure 11:
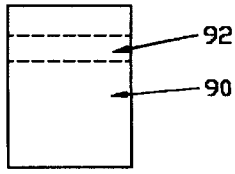
FIG. 11 is a side elevation schematic view of an alternate weight element suitable for mounting upon the set screw or threaded stem of the archery bow stabilizer of the present invention to be captured between the first and second weight bodies thereof.

As previously noted, set screw 20 or integral threaded stem 48 may be of varying length to accommodate different bows or additional weight elements or washers mounted thereon which in cooperation with the first and second weight bodies of the present invention provide additional potential variation to the overall weight of the subject archery bow stabilizer to accommodate differing archer needs, archery equipment, and shooting conditions. FIG. 9, FIG. 10, and FIG. 11 illustrate samples of additional weight elements cooperative with the first and second weight bodies of the present invention which serve as inside mounted pieces set upon set screw 20 or threaded stem 48 to ultimately be selectably and releasably captured between the first and second weight bodies of the present invention. FIG. 9 illustrates an o-ring weight element 82 having central hole 84. FIG. 10 illustrates an aligned cylindrical weight element 86 having a through hole 88 extending throughout its central logitudinal axis which may serve as a spacer element and weight which is longitudinally axially aligned between the first and second weight bodies of the present invention. FIG. 11 illustrates an alternative block weight element 90 having a through hole 92 extending throughout a non-central longitudinal axis thereof. The weight elements of the present invention thus may consist of blocks, cylinders, spacers, rings, washers, nuts, or other weighted pieces having a through hole or threaded bore therein thereby providing for a great degree of variation in the final composite archery bow stabilizer customized to and archer's needs and archery circumstances.

The archery bow stabilizer of the present invention is mounted to a bow simply by engaging a hole of the bow with either the set screw 20 or integral threaded stem 48 attached to and extending from one of the weight bodies such that a portion of the set screw or stem element extends through the hole to be available to engage the other weight body and thereby provide a releasable connection of both weight bodies in a single axially aligned plane intersecting the bow and disposing the bow between both weight bodies such that the joined weight bodies form a stabilizer assembly of sufficient mass to provide inertial resistance for stabilizing the bow against movement.

From the foregoing description, it will be apparent that the archery bow stabilizer of the present invention has a number of advantages, some of which have been described above and others of which are inherent in the invention. Also, it will be understood that modifications can be made to the archery bow stabilizer or its environment of use described above without departing from the teachings of the present invention. Accordingly, the scope of the invention is only to be limited as necessitated by the accompanying claims.

I claim:

1. An archery bow stabilizer comprising a first weight body and a second weight body, means for engaging at least one of said weight bodies to an archery bow, and means for releasably connecting said first and second weight bodies to each other in a single longitudinal axially aligned plane relative to each other intersecting said bow and disposing said bow between said first and second weight bodies, said first and second weight bodies when so connected forming a stabilizer assembly having sufficient mass to provide inertial resistance for stabilizing said bow against movement.

2. An archery bow stabilizer according to claim 1 wherein said means for engaging at least one of said weight bodies to an archery bow comprises said weight body having a stem element attached thereto and extending therefrom cooperative with a hole of said archery bow.

3. An archery bow stabilizer according to claim 1 wherein said means for releasably connecting said first and second weight bodies to each other in a single longitudinal axially aligned plane intersecting said bow and disposing said bow between said first and second weight bodies comprises at least one of said weight bodies having a threaded bore at a longitudinal axis thereof and the other weight body having a threaded stem attached thereto and extending from a longitudinal axis thereof engaging said threaded bore.

4. An archery bow stabilizer according to claim 3 further including at least one washer mounted on said threaded stem to brace against said bow when said first and second weight bodies are releasably connected.

5. An archery bow stabilizer according to claim 1 wherein said means for releasably connecting said first and second weight bodies to each other in a single longitudinal axially aligned plane intersecting said bow and disposing said bow between said first and second weight bodies comprises said first and second weight bodies each having a threaded bore at the longitudinal axis thereof cooperative with a set screw having a first end portion and a second end portion, said first end portion engaging the threaded bore of one of said weight bodies and said second end portion engaging the threaded bore of the other weight body.

6. An archery bow stabilizer according to claim 5 further including at least one washer mounted on said set screw to brace against said bow when said first and second weight bodies are releasably connected.

7. An archery bow stabilizer according to claim 1 wherein said first and second weight bodies are releasably connected to each other at an angle perpendicular to a side surface of said bow and extend to the left and right of said bow.

8. An archery bow stabilizer according to claim 1 wherein said first and second weight bodies are of differing masses.

9. An archery bow stabilizer according to claim 1 wherein either or both of said first and second weight bodies are comprised of a plurality of cooperative weight units.

10. An archery bow stabilizer according to claim 9 wherein said plurality of cooperative weight units comprise a first weight unit having a through hole receiving a stem element of a second weight unit.

11. An archery bow stabilizer according to claim 1 further including a weight element mounted upon said means for releasably connecting said first and second weight bodies to each other in a single longitudinal axially aligned plane relative to each other.

12. An archery bow stabilizer according to claim 11 wherein said weight element is selected from the group consisting of a block, cylinder, spacer, washer, nut, or other weighted piece having a through hole.

13. And archery bow stabilizer according to claim 1 wherein at least one of said first and second weight bodies has a recessed face suited for cooperation with a lock ring.

14. An archery bow comprising a bow having at least one hole therein, a first weight body, and a second weight body, means for engaging at least one of said weight bodies to said hole of said bow, and means for releasably connecting said first and second weight bodies to each other in a single longitudinally axially aligned plane relative to each other intersecting said bow and disposing said bow between said first and second weight bodies, said first and second weight bodies when so connected to the bow forming a stabilizer assembly therefor having sufficient mass to provide inertial resistance for stabilizing said bow against movement.

15. A method of stabilizing an archery bow comprising the steps of engaging a hole of an archery bow with a stem element attached to and extending from a first weight body such that a portion of said stem element extends through said hole, and mounting a second weight body upon said extended portion of said stem element of said first weight body to thereby form a releasable connection of said first and second weight bodies in a single longitudinally axially aligned plane intersecting said bow and disposing said bow between said first and second weight bodies, said first and second weight bodies when so connected forming a stabilizer assembly of sufficient mass to provide inertial resistance for stabilizing said bow against movement.

* * * * *